US005876066A

United States Patent [19]

Petkov

[11] Patent Number: 5,876,066

[45] Date of Patent: Mar. 2, 1999

[54] CARVING SKI POLE

[76] Inventor: Ivan Petkov, 449 Mt. Laurel Dr., Aspen, Colo. 81612

[21] Appl. No.: 757,703

[22] Filed: Dec. 3, 1996

[51] Int. Cl.[6] ..... A63C 11/22

[52] U.S. Cl. ..... 280/819

[58] Field of Search ..... 280/819, 820, 280/822, 823, 47.3, 1.5, 826; 135/65, 66, 69, 75

[56] References Cited

U.S. PATENT DOCUMENTS

| | | | |
|---|---|---|---|
| 234,655 | 11/1880 | Caldwell et al. | 280/819 |
| 2,002,108 | 5/1935 | Child | 473/239 |
| 2,214,079 | 9/1940 | Horton | 473/245 |
| 2,439,288 | 4/1948 | Evans | 280/47.3 |
| 2,818,290 | 12/1957 | Harocopo | 280/823 |
| 2,893,021 | 7/1959 | Lundborg | 416/63 |
| 3,525,532 | 8/1970 | Baldsiefen | 280/823 |
| 3,722,903 | 3/1973 | Jones | 280/823 |
| 4,288,102 | 9/1981 | Ramer | 280/823 |
| 4,424,987 | 1/1984 | Ryder | 280/823 |
| 4,596,405 | 6/1986 | Jones | 280/823 |
| 4,962,781 | 10/1990 | Kanbar | 135/65 |
| 5,005,845 | 4/1991 | Haueter, Jr. | 280/1.5 |
| 5,139,283 | 8/1992 | Dow et al. | 280/819 |
| 5,236,222 | 8/1993 | Fletcher | 280/809 |
| 5,312,135 | 5/1994 | Karabees | 280/826 |
| 5,458,427 | 10/1995 | Simond | 403/109 |
| 5,538,354 | 7/1996 | Simond | 403/109 |
| 5,653,468 | 8/1997 | Ostapyk | 280/809 |
| 5,687,991 | 11/1997 | Gairdner | 280/826 |

*Primary Examiner*—J. J. Swann
*Assistant Examiner*—Bridget Avery
*Attorney, Agent, or Firm*—Dergosits & Noah LLP

[57] ABSTRACT

A carving ski pole for assisting a skier/snowboarder in balancing on and carving through snow. The carving ski pole comprises a first shaft member detachably coupled to a second shaft member. A first arcuate gliding member is coupled to the free end of the first shaft member and a second arcuate gliding member is coupled to the free end of the second shaft member. The first and second shaft members each also have extendible arms for lengthening the overall length of the carving ski pole.

13 Claims, 5 Drawing Sheets

CARVING SKI POLE

FIELD OF THE INVENTION

This invention relates to the field of ski poles. More specifically, this invention relates to a ski pole for assisting skiers/snowboarders in balancing on and carving through snow.

BACKGROUND OF THE INVENTION

Skiing and snowboarding are widely popular sports which require a great deal of skill. Learning and mastering proper balance and control of skis/snowboards and the skier's/snowboarder's body are crucial to effectively performing these sports. This is true not only for enjoyment of the sport but also for safety. Because of the uneven and steep slopes usually traveled by these skiers/snowboarders, the skier's/snowboarder's body is constantly in new and unsupported positions which require continuous adjustments.

One of the ultimate goals of most skiers and snow boarders is mastering the technique known as carving. Unfortunately, techniques learned by beginners often need to be "unlearned" later as they become more proficient. The use of the present invention will avoid beginner skiers/snowboarders from having to unlearn the techniques they learned as a beginner when they progress to intermediate and expert levels. Using the carving ski pole as a beginner, teaches the skier/snowboarder the proper techniques which are used by advanced skiers/snowboarders.

Many devices have been designed to teach the art of carving through the snow. Unfortunately, none of them allow skiers/snowboarders to plant a ski pole confidently without losing their balance or control. What is needed is a device that will assist skiers/snowboarders in maintaining their balance on and carving through snow.

SUMMARY OF THE INVENTION

The present invention provides for a carving ski pole comprising: a) a shaft having a first end and an opposite second end; b) a first arcuate gliding surface coupled to the first end of the shaft; and c) a second arcuate gliding surface coupled to the second end of the shaft. The carving ski pole may further be designed wherein the shaft has an adjustable length.

The carving ski pole may further be designed wherein the first arcuate gliding surface is rotatably coupled to the first end of the shaft and the second arcuate gliding surface is rotatably coupled to the second end of the shaft. Still further, the carving ski pole may be designed wherein the first arcuate gliding surface is pivotally coupled to the first end of the shaft and the second arcuate gliding surface is pivotally coupled to the second end of the shaft.

In another preferred embodiment the carving ski pole comprises: a) a first shaft member having a first end and an opposite second end; b) a second shaft member also having a first end and an opposite second end whereby the second end of the first shaft member is detachably coupled to the second end of the second shaft member; c) a first arcuate gliding surface coupled to the first end of the first shaft member; and d) a second arcuate gliding surface coupled to the first end of the second shaft member. The carving ski pole may further be designed wherein the first and the second shaft members each have adjustable lengths.

The carving ski pole may further be designed wherein the first arcuate gliding surface is rotatably coupled to the first end of the first shaft member and the second arcuate gliding surface is rotatably coupled to the first end of the second shaft member. Still further, the carving ski pole may be designed wherein the first arcuate gliding surface is pivotally coupled to the first end of the first shaft member and the second arcuate gliding surface is pivotally coupled to the first end of the second shaft member.

In yet another preferred embodiment, the carving ski pole comprises: a) a plurality of legs each extending substantially horizontally from a common point before curving downward and terminating at a first end; b) a plurality of joints each coupled to one of the plurality of first ends; and c) a plurality of arcuate gliding surfaces each coupled to one of the plurality of joints.

DETAILED DESCRIPTION OF THE PREFERRED EMBODIMENT

The present invention is a device for teaching skiers/snowboarders proper movement and balance while carving through snow. More specifically, the present invention is a carving ski pole that can be used to assist skiers/snowboarders in balancing on and carving through snow. This provides for faster and easier introduction to proper technique at an earlier stage in the learning process. It is also contemplated that the present invention has application in water sports such as surfing.

Figure 1:
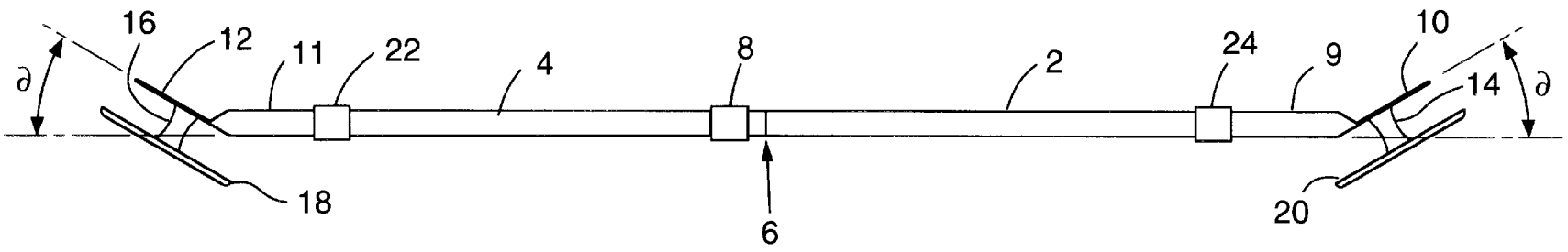
FIG. 1 illustrates a side view of a carving ski pole according to the present invention.

FIG. 1 illustrates a side view of the preferred carving ski pole of the present invention. The carving ski pole comprises a first shaft member 2 and a second shaft member 4 removably secured together at seam 6. Locking member 8 removably secures the first shaft member 2 and the second shaft member 4 together. The first and second shaft members 2 and 4 can be designed from any rigid material including metal, plastic and composites. In the preferred embodiment, the first and second shaft members 2 and 4 are constructed from a metal composite similar to that used for windsurfing booms. The first and second shaft members can also be formed from a plastic composite or any other material that has similar strength and weight characteristics and varying flexibilities.

It should be noted that although the preferred embodiment describes the carving ski pole as comprising a first shaft member 2 and a second shaft member 4, it is also contemplated that the carving ski pole be formed from a unitary ski pole. It is further contemplated that the carving ski pole be curved or have at least one defined bend. It is also contemplated that the carving ski pole be capable of collapsing (i.e. folding in half) by incorporating hinges or other similar devices.

The first and second shaft members 2 and 4 can also be surrounded by soft, resilient foam as a cushion grip that provides the skier/snowboarder with a better grip on the carving ski pole. The cushion grip may be fabricated from a light weight resilient polymer such as urethane or other foam polymers known in the art.

In the preferred embodiment, the locking member 8 is a spring pin device manufactured by DDG, Inc./Windsurfing Hawaii in Stevenson, Wash., and described in more detail below and in FIG. 3. The locking member 8 can, however, include any design for adjustably securing the first shaft member 2 to the second shaft member 4. This includes but is not limited to a threaded collar which tightens around the shafts when rotated in one direction and loosens when rotated in the opposite direction, as well as a spring-activated ball bearing mechanism. Additionally, in place of the locking member 8, the end of the second shaft member 4 can be a threaded female opening for receiving the threaded male end of the first shaft member 2. It is also contemplated that the male and female ends be reversed.

FIG. 1 further illustrates that the first shaft member 2 is configured to receive a telescoping extension arm 9. A locking member 24 (similar to locking member 8) allows the extension arm 9 to be adjustably extended outward from the first shaft member 2 in measured increments. The second shaft member 4 is similarly configured to receive a telescoping extension arm 11. Another locking member 22 (again, similar to locking member 8) allows the extension arm 11 to be adjustably extended outward from the second shaft member 4 in measured increments equal to those for extension arm 9. This allows the carving ski pole to be equally balanced about its midpoint when the extension arms are extended. Although the carving ski pole, including the extension arms, can have any length, the preferred length ranges between 3 and 15 feet. Furthermore, although the preferred embodiment describes the carving ski pole as extendible at its ends, it is also contemplated that the carving ski pole be extendible at or near its mid-point. This can be accomplished, for example, by incorporating a number of measured apertures (not shown) in the first shaft member 2 (adjacent to the aperture 32 shown in FIG. 3) so that the length of the carving ski pole can be adjusted by inserting the pin 34 of locking member 8 (see FIG. 3) into the different measured apertures.

Figure 2:
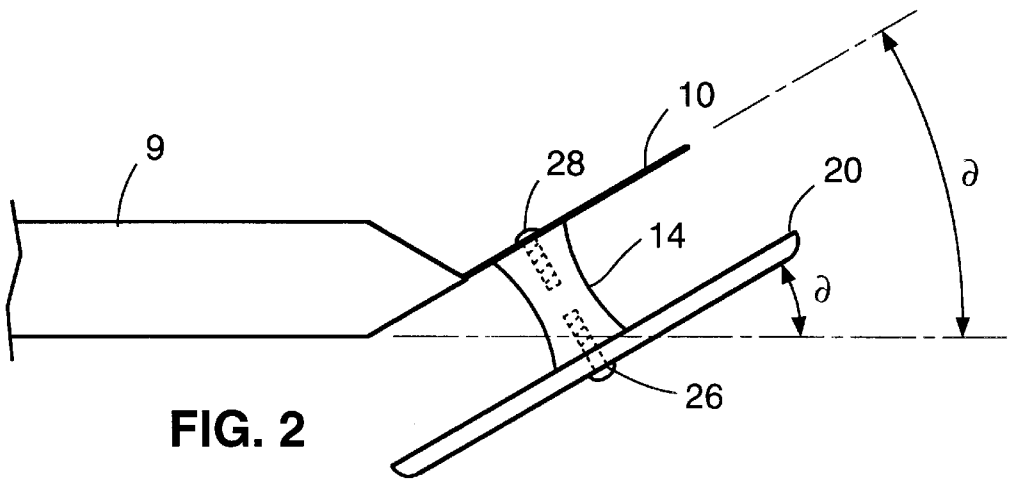
FIG. 2 illustrates a magnified side view of the one end of the carving ski pole.

Referring now to FIGS. 1 and 2, in the preferred embodiment the ends 10 and 12 of the extension arms 9 and 11 are crimped at a predetermined angle $\alpha$ measured from the horizontal axis which can range between 0° and 90°, but most preferably, between 0° and 30°. It is preferable that the crimped ends 10 and 12 are displaced at the same angle $\alpha$ in relation to the corresponding shaft member and extension arm, but it is not absolutely necessary. It should be noted, however, that the ends of the extension arm do not have to be crimped. Instead, the ends of the extension arms 9 and 11 can have the same diameter as the extension arms themselves. In addition, the ends of the extension can incorporate any well known means for providing angularity to the ends of the extension arms 9 and 11, without the need for the ends of the extension arms to be formed at angles. Although in the preferred embodiment the angles $\alpha$ of the extension arm ends are fixed, it is also contemplated that the ends of the extension arms incorporate any well known means for permitting the skier/snowboarder to adjust the angles of the ends of the extension arms. This will allow the skier/snowboarder to adjust the angle $\alpha$ depending on his or her preference.

As further shown in FIGS. 1 and 2, joints 14 and 16 are secured to the crimped ends 10 and 12 respectively of the extension arms. In the preferred embodiment, the joint 14 is secured to the crimped end 10 by a screw 28 such that the joint 14 is secured substantially perpendicular to the crimped end 10. It should be noted, however, that the joints 16 and 14 may also be coupled to the crimped ends at predetermined angles that are not substantially 90° (i.e. perpendicular).

Joints 14 and 16 provide a flexible point of contact between the arcuate gliding surfaces 18 and 20 and the crimped extension ends 10 and 12. This allows the carving ski pole to remain at a fixed angle relative to the skier's/snowboarder's body while allowing the arcuate gliding surfaces to remain parallel to the snow surface despite changing terrain (i.e. due to bumps and valleys). It is important, however, that the joints 14 and 16 not be too flexible that they will easily give way upon the application of a skier's/snowboarder's body weight. The preferred embodiment contemplates that the joints 14 and 16 be power joints (used to join the sail/mast rig to the windsurfing body) manufactured, for example, by DDG, Inc./Windsurfing Hawaii. It should be noted, however, that any material may be used for the joints so long as they provide sufficient flexibility. It is also contemplated that joints of different flexibility also be available so that skiers/snowboarders can customize the "feel" of the carving ski pole.

Arcuate gliding surfaces 18 and 20 are coupled to the joints 16 and 14 such that the convex side of the arcuate gliding surfaces are opposite the joints 14 and 16. It should also be noted that the joints 14 and 16 are not necessary for the operation of the present invention. The present invention can operate by securing the arcuate gliding disks directly to the crimped ends 10 and 12 of the extension arms.

The arcuate gliding surfaces 18 and 20 can be manufactured from almost any material including dense plastics and composites. It is important that the arcuate gliding surfaces 18 and 20 be rigid enough that they do not significantly deform upon application of a skier's/snowboarder's weight and are sufficiently smooth that they will slide across snow. In a preferred embodiment, the arcuate gliding surfaces 18 and 20 are manufactured from a hard plastic or composite.

The arcuate gliding surfaces 18 and 20 are for providing a pivot or support point for the skier/snowboarder and can have a number of different shapes including, but not limited to, curved "bowl" shapes, semi-spherical and fully spherical shapes. In a preferred embodiment the arcuate gliding surfaces 18 and 20 have a "Frisbee™" shape. Furthermore, although the arcuate gliding surfaces 18 and 20 can have almost any surface area, the preferred embodiment has a minimum of 4 square inches with a preferred diameter of between 3 and 5 inches.

In the preferred embodiment as shown in FIG. 2, the arcuate gliding surface 20 is secured to the joint 14 by a screw 26 such that the arcuate gliding surface 20 is substantially perpendicular to the joint 14 and substantially parallel to the crimped end 10. It should be noted, however, that the arcuate gliding surfaces 18 and 20 may be coupled to the joints 16 and 14 at predetermined angles that are not substantially 90° (i.e. perpendicular).

Although the preferred embodiment describes the crimped end 10 and the arcuate gliding surface 20 as being secured to the joint 14 by screws 28 and 26, it is contemplated that other known devices besides screws may be used which are within the skill of the ordinary artisan. In addition, the arcuate gliding surfaces 18 and 20 can be rotatably and/or pivotally coupled to the joints 14 and 16.

Figure 3:
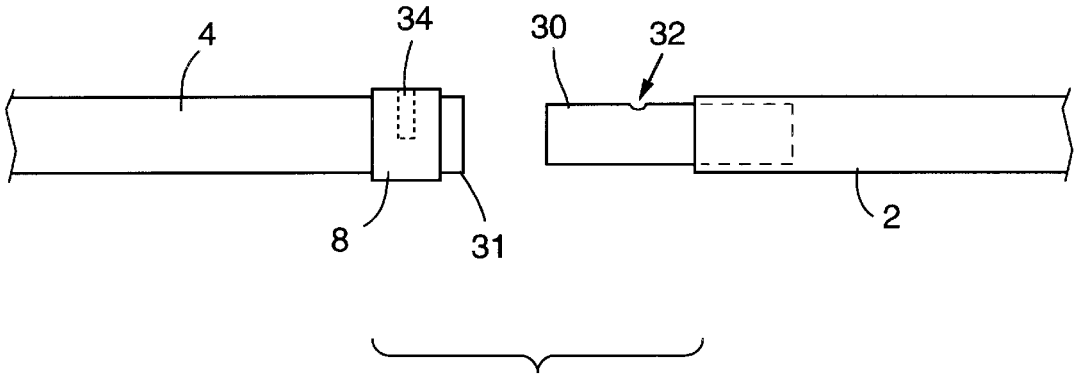
FIG. 3 is a side view showing how the first and second shaft members are coupled together.

FIG. 3 illustrates the locking member 8 in more detailed. In the preferred embodiment, the second shaft member 4 is configured to receive the first shaft member 2. Essentially, the inside diameter of the end 31 of the second shaft member 4 is larger than the outside diameter of the end 30 of the first shaft member 2, so that the end 30 of the first shaft member 2 fits snugly within the end 31 of the second shaft member 4. The outside diameter of the remaining portion of the shaft member 2 is larger than the outside diameter of end 30, and equal to the outside diameter of shaft member 4. It is also contemplated that the first shaft member 2 could be configured to receive the second shaft member 4 in the same manner. Although in the preferred embodiment, the outside diameter at only a portion of the end of one of the shaft members is small enough to be accepted by the other shaft member, it is also contemplated that the shaft member having the smaller outside diameter has a uniform outside diameter.

In the preferred embodiment, the locking member 8 is positioned on the second shaft member 4 and includes a pin 34 which can be removably inserted into the aperture 32 in the first shaft member 2 for securing the two shaft members together. As mentioned above, placement of the locking member 8 on one or the other shaft members depends on which shaft member is inserted into the other shaft member. The locking member 8 must be located on the shaft member that receives the other shaft member. Of course, placement of different locking members will depend on their particular design.

Figure 4:
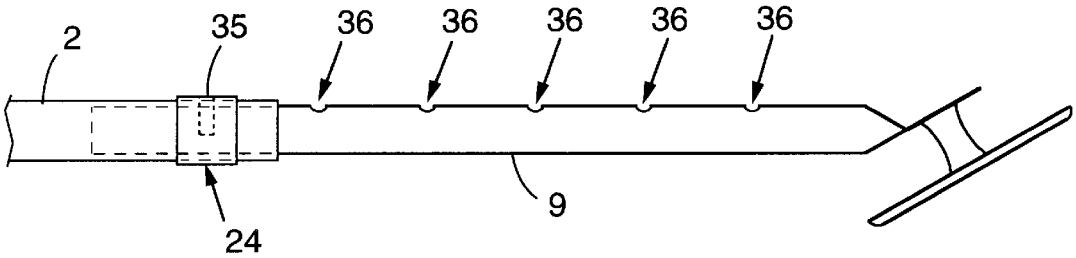
FIG. 4 illustrates a side view of an extension arm coupled to the first shaft member.

As mentioned above, the first and second shaft members 2 and 4 may also comprise extensions 9 and 11 for increasing the overall length of the carving ski pole. FIG. 4 illustrates the first shaft member 2 and its corresponding extension arm 9. A locking member 24 similar to the locking member 8 is used to secure the extension arm 9 to the first shaft member 2. Here, the extension arm 9 is configured with a plurality of apertures 36 each for receiving the pin 35. By inserting the pin 35 into a particular one of the apertures 36, a skier/snowboarder can adjust the overall length of the carving ski pole. The second shaft member 4 and extension arm 11 are similarly configured having equally spaced apertures. In the preferred embodiment, the first and second extension arms should be extended equally in order to provide for proper balance of the carving ski pole. Although described here incorporating the specific locking member 24, it is contemplated that other devices known in the art be incorporated to adjustably secure the extension arms 9 and 11 to the first and second shaft members 2 and 4, respectively, as described above regarding FIG. 1 and locking member 8. For example, the threaded collar or spring-activated ball bearing mechanisms described above with respect to locking member 8 can also be incorporated here.

In use, the skier/snowboarder holds the ski pole in both hands across his or her body such that the arcuate gliding surfaces face toward the ground. As the skier/snowboarder travels down a hill, he or she dips one end of the pole such that one of the arcuate gliding surfaces glides across the surface of the snow. This provides the skier/snowboarder with a point of contact with the snow. This point of contact serves to support the skier's/snowboarder's body and provides a pivot point for initiating a turn. After completing a partial pivot (e.g. 75°–100°) about the pivot point, the skier/snowboarder pulls up the dipped end of the carving ski pole, dips the opposite end and repeats the procedure for initiating and completing a turn in the opposite direction.

By pivoting around the contact points, the skier/snowboarder is able to initiate and complete a turn without the fear of falling. The use of the present invention will assist the skier in eliminating mistakes in balance and/or control, thereby producing a more forgiving environment in which to learn how to ski or snowboard. The contact point also forces the skier/snowboarder to increase the edge angle between the skis/snowboard and the hill, thereby forcing the skiers/snowboarders to "carve" through the snow.

The adjustable length described above allows skiers/snowboarders of different skill levels to take advantage of the present invention. Beginners will want a longer carving ski pole while a more advanced skier/snowboarder will want a shorter carving ski pole. By decreasing the length of the carving ski pole, the skier/snowboarder is forced to make smaller turns thereby increasing the edge angle.

Figure 5:
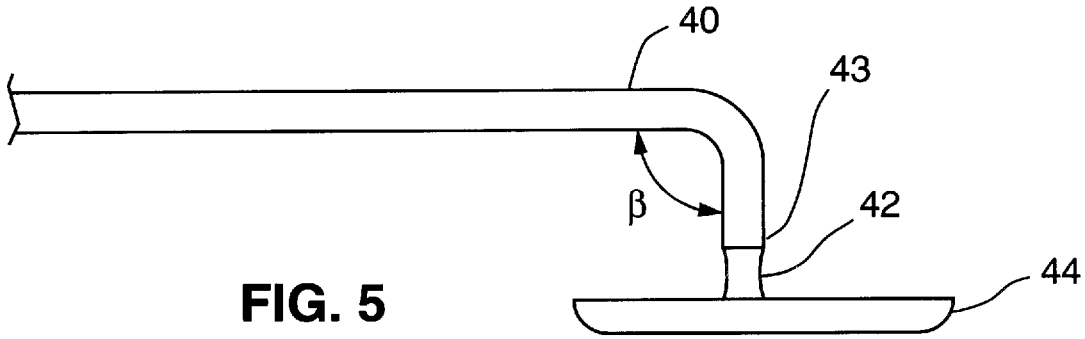
FIG. 5 illustrates a side view of one end of another embodiment of the carving ski pole.
Figure 6:
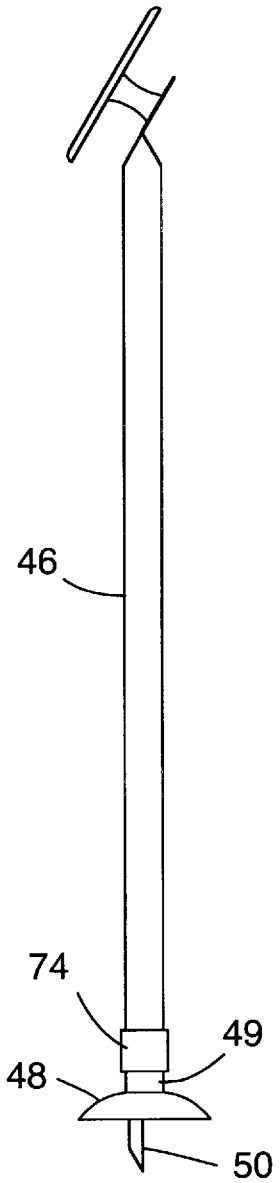
FIG. 6 illustrates a first shaft member of another embodiment of the carving ski pole.

FIG. 5 illustrates one side of another embodiment of the present invention wherein the ends of the extension arms are bent at an angle β which is substantially 90°. A joint 42 is coupled to the end 43 of the extension arm 40 such that the longitudinal axis of the joint 42 is substantially coaxial with the end 43 of the extension arm 40. Furthermore, an arcuate gliding surface 44 is coupled substantially perpendicular to the joint 42. As with the preferred embodiment, the arcuate gliding surface 44 may be coupled directly to the exposed end of the shaft 40 without the joint 42 and may be coupled by a screw (not shown) or any other well known coupling device.

FIGS. 6, 7, 7*a* and 7*b* illustrate another embodiment wherein the ends 49 and 51 of the first and second shaft members 46 and 52 have baskets 48 and 54 and tips 50 and 56 at opposite ends from the arcuate gliding surfaces. The baskets and tips are similar to those present on conventional ski poles. Additionally, grips or handles (not shown) similar to conventional ski pole handles may be coupled to the first and second shafts just below the crimped ends and/or just below the baskets 48 and 54. It is contemplated that a coupling mechanism different than that described below with reference to FIG. 7*b* may need to be used if grips or handles are located below the baskets on the first and second shaft members. In this instance, selection of a compatible coupling mechanism is within the skill of the ordinary artisan.

The use of the arcuate gliding surfaces in combination with the tips and baskets permits the first and second shaft members to be used independently as traditional ski poles. When combined for use as a carving ski pole, the skier/snowboarder holds the first shaft member 46 at the grip (not shown) located near the basket in one hand, and the second shaft member 52 in a similar location in the other hand so that the arcuate gliding surfaces 47 and 53 contact the snow. When used as a traditional ski pole, the skier/snowboarder holds the first shaft member 46 at the grip (not shown) located near the arcuate gliding surfaces in one hand, and the second shaft member 52 in a similar location in the other hand so that the tips 50 and 56 contact the snow. Thus, a skier/snowboarder can use the first and second shaft members 46 and 52 as conventional ski poles to assist him or her in moving about and proceeding to a ski lift. Preferably, the first and second shaft members 46 and 52 are between 2 and 7 feet in length.

Figure 7:
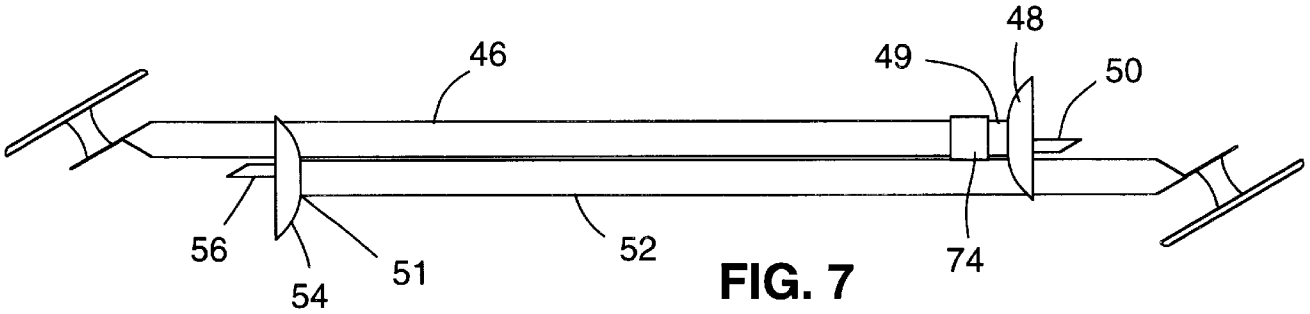
FIG. 7 illustrates the first shaft member shown in FIG. 6 coupled to a second shaft member.
Figure 7A:
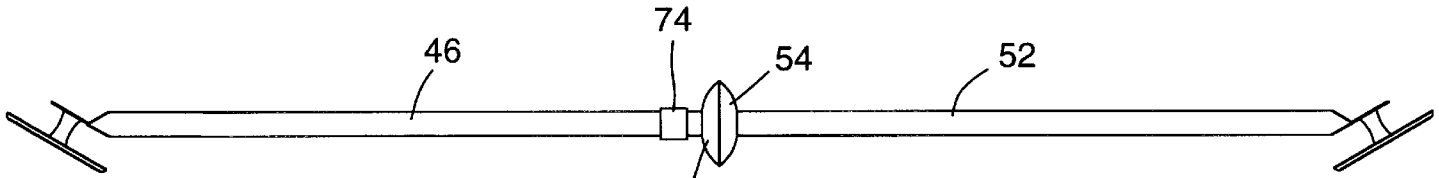
FIG. 7*a* illustrates another embodiment of the carving ski pole.
Figure 7B:
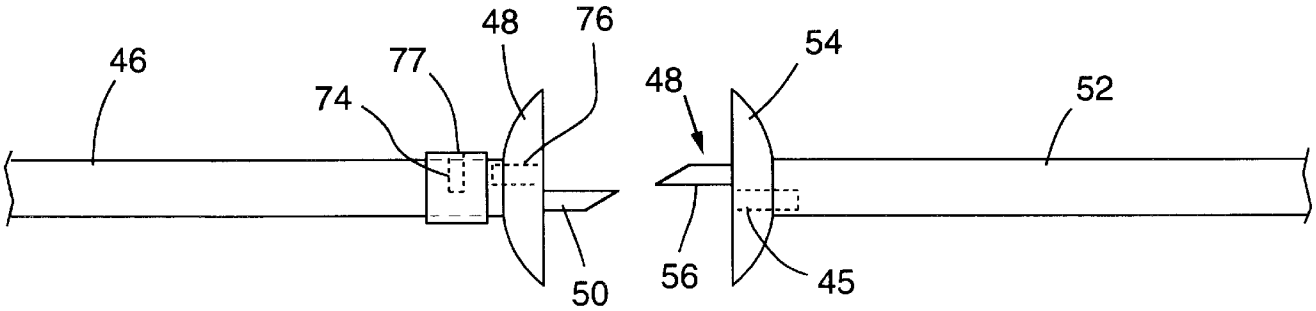
FIG. 7*b* illustrates the embodiment of the carving ski pole shown in FIG. 7*a* wherein the first and second shaft members are separated.

As shown in FIGS. 7*a* and 7*b*, the first shaft member 46 and second shaft member 52 may also be coupled together to function in the same manner as the carving ski pole shown in FIG. 1. To accomplish this, the tip 50 of the first shaft member 46 is inserted into an aperture 75 located in the end of the second shaft member 52 adjacent and parallel to the tip 56 and the tip 56 of the second shaft member 52 is inserted into an aperture 76 located in the end of the shaft member 46 adjacent and parallel to tip 50. Pin 77 of locking member 74 is then inserted into the aperture 78 located in tip 56. While FIG. 7*b* illustrates one manner of coupling the first and second shaft members 46 and 52 together, one of ordinary skill in the art will be able to implement other known ways for coupling the shafts together.

Referring now to FIG. 7, when the skier/snowboarder is getting onto or off of a lift or wants to store the carving ski poles, he or she can secure the first shaft member 46 and second shaft member 52 together with known adjustable hand connectors (not shown).

Figure 8:
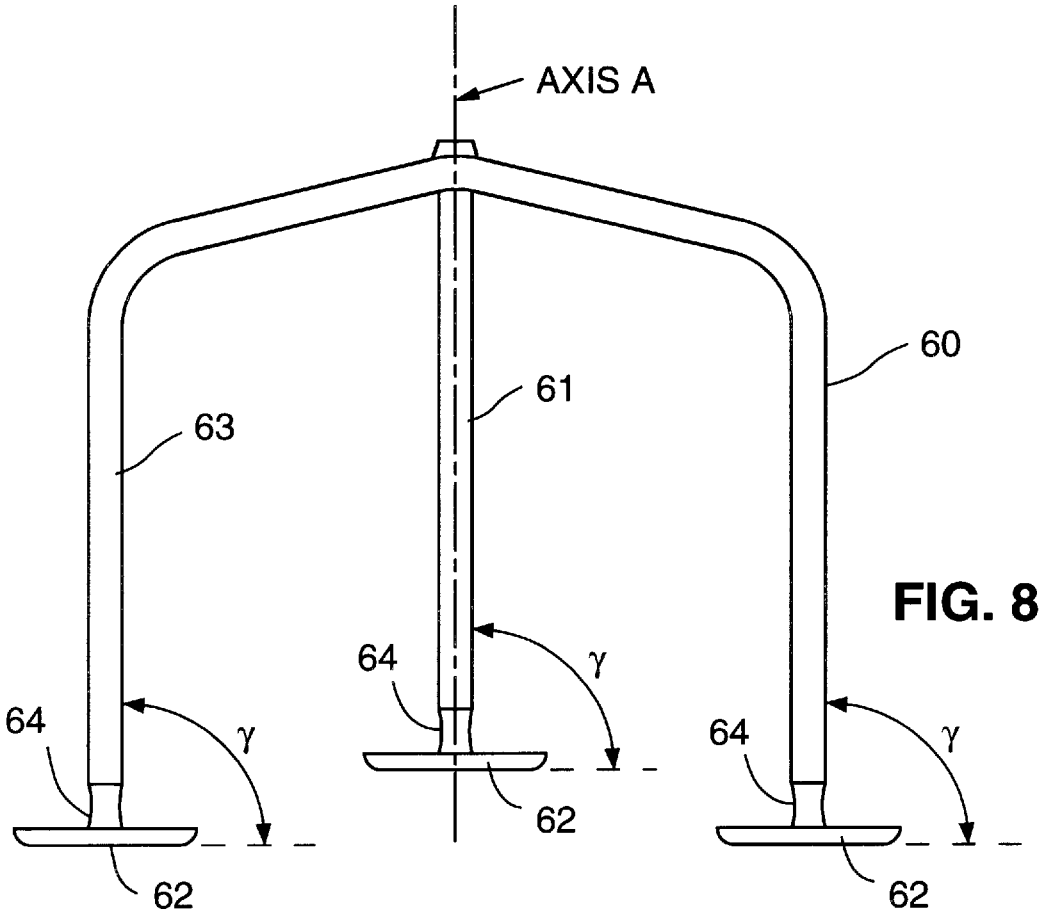
FIG. 8 illustrates a side view of another embodiment of the present invention.
Figure 9:
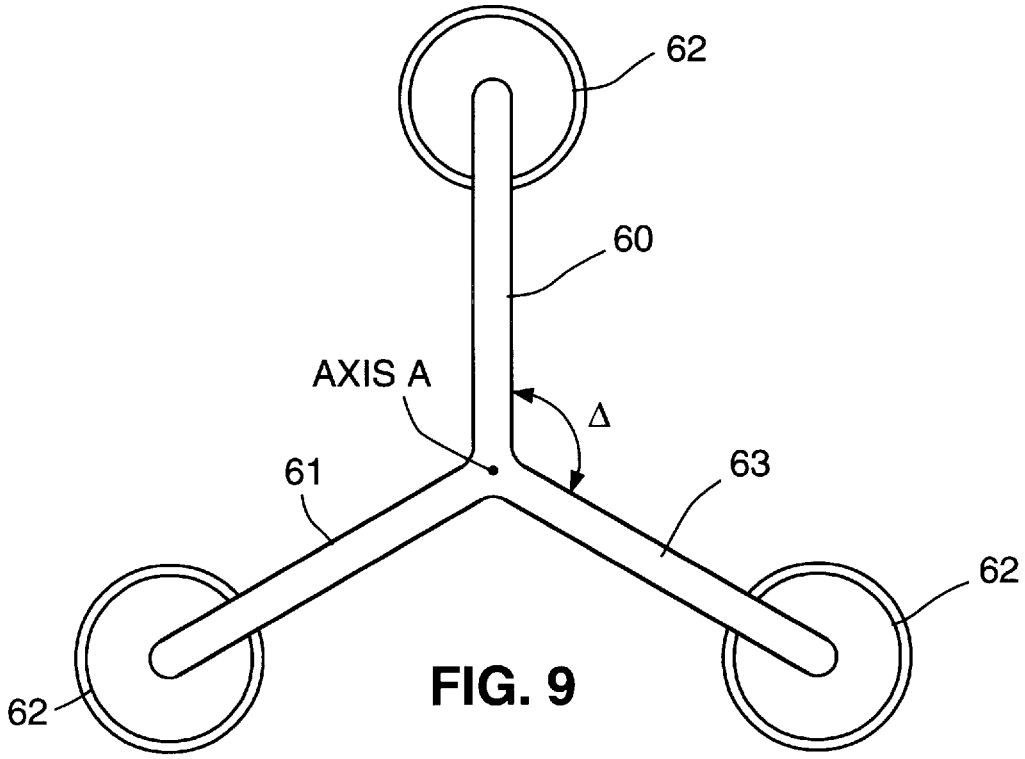
FIG. 9 illustrates a top view of the embodiment illustrated in FIG. 8.

FIGS. 8 and 9 illustrate a side and top view of another embodiment for assisting a beginner skier/snowboarder in maintaining his or her balance. This embodiment incorporates three legs 60, 61, and 63 extending substantially horizontally from a common point before bending downward. Each leg 60, 61 and 63 is separated from each other by an angle Δ. Preferably, this angle Δ is 120°. At the base of each leg is a joint 64 and arcuate gliding surface 62 similar to those incorporated into the original embodiment described above. Alternatively, the arcuate gliding surfaces can be coupled directly to the legs instead of to a joint. Although illustrated here wherein the lower portion of the legs are straight and substantially perpendicular to the ground (i.e. γ is substantially equal to 90°), they may also be curved, have at least one predetermined bend or be designed wherein the angle γ is not equal to 90°. The legs 60, 61 and 63 can be formed from the same material as the original embodiment described above (i.e. metal, metal composite, plastic composite, etc.) The legs can also incorporate a cushion grip for improving a skier's/snowboarder's grip.

Although FIGS. 8 and 9 illustrate the preferred embodiment of the invention as having three legs, it is also contemplated that more or less legs may be incorporated without departing from the scope of the invention. Furthermore, many of the alternate embodiments described above with reference to the original embodiment are also contemplated for incorporation with the tripod embodiment. For example, the legs may be extendible. Furthermore, the tripod embodiment may be capable of breaking down wherein the legs are each removably coupled to a common centerpiece or "hub," in the same manner that the first and second shaft members 2 and 4 of FIG. 1 are coupled to each other. This would make the device easier to transport. Still further, the legs 60, 61 and 63 may be capable of folding together, wherein the legs are adjustably rotatable about the axis A, the centerpoint, illustrated in FIGS. 8 and 9.

In operation, a skier/snowboarder grips any two of the three legs facing the third leg and presses the ski pole down on the surface of the snow as he or she progresses down the hill. This embodiment assists a skier/snowboarder in maintaining his or her balance as he or she travels down a hill. It may also assist the skier/snowboarder in carving through the snow.

While the present invention has been described in detail by way of illustration and example for purposes of clarity of understanding, it will be understood by those skilled in the art that certain changes and modifications may be made to the above-described embodiments without departing from the spirit of the invention and scope of the appended claims.

What is claimed is:

1. A carving ski pole comprising:

a) a shaft having a first end and an opposite second end;

b) a first arcuate gliding surface coupled to the first end of the shaft; and c) a second arcuate gliding surface coupled to the second end of the shaft d) a first flexible joint which provides the coupling between the first gliding surface and the first end of the shaft; and e) a second flexible joint which provides the coupling between the second gliding surface and the second end of the shaft, wherein when the skier brings either gliding surface in contact with a dynamic surface the skier is traversing, the shaft remains at a fixed angle relative to the skier while the gliding surface in contact with the dynamic surface remains positioned parallel to the dynamic surface.

2. The carving ski pole of claim 1 wherein the shaft has an adjustable length.

3. The carving ski pole of claim 1 wherein the first arcuate gliding surface is rotatably coupled to the first end of the shaft and the second arcuate gliding surface is rotatably coupled to the second end of the shaft.

4. The carving ski pole of claim 1 wherein the first arcuate gliding surface is pivotally coupled to the first end of the shaft and the second arcuate gliding surface is pivotally coupled to the second end of the shaft.

5. A carving ski pole comprising:

a) a first shaft member having a first end and an opposite second end;

b) a second shaft member also having a first end and an opposite second end whereby the second end of the first shaft member is detachably coupled to the second end of the second shaft member;

c) a first arcuate gliding surface coupled to the first end of the first shaft member; and d) a second arcuate gliding surface coupled to the first end of the second shaft member.

6. The carving ski pole of claim 5 wherein the first arcuate gliding surface is rotatably coupled to the first end of the first shaft member and the second arcuate gliding surface is rotatably coupled to the first end of the second shaft member.

7. The carving ski pole of claim 5 wherein the first arcuate gliding surface is pivotally coupled to the first end of the first shaft member and the second arcuate gliding surface is pivotally coupled to the first end of the second shaft member.

8. The carving ski pole of claim 5 wherein the first and the second shaft members each have adjustable lengths.

9. The carving ski pole of claim 1 wherein the first arcuate gliding surface and the second arcuate gliding surface each has a surface area of at least 4 square inches.

10. The carving ski pole of claim 5 wherein the second end of the first shaft further comprises an aperture and the second end of the second shaft further comprises a pin, wherein the first shaft is coupled to the second shaft when the pin is removably inserted into the aperture.

11. The carving ski pole of claim 5 wherein the second end of the first shaft further comprises a plurality of apertures and the second end of the second shaft further comprises a pin, wherein when the pin is removably inserted into one of the apertures the first shaft and the second shaft are coupled at a predefined length.

12. The carving ski pole of claim 1 wherein the flexible joint is a power joint.

13. A carving ski pole comprising:

a) a plurality of legs each extending substantially horizontally from a common point before curving downward and terminating at a first end;

b) a plurality of joints each coupled to one of the plurality of first ends; and c) a plurality of arcuate gliding surfaces each coupled to one of the plurality of joints.

* * * * *